US006539769B1

(12) United States Patent
McDaniel

(10) Patent No.: US 6,539,769 B1
(45) Date of Patent: Apr. 1, 2003

(54) BRIDGE STRAIGHTNER AND METHOD

(76) Inventor: Patrick N. McDaniel, P.O. Box 7330, Roanoke, VA (US) 24019

( * ) Notice: Subject to any disclaimer, the term of this patent is extended or adjusted under 35 U.S.C. 154(b) by 212 days.

(21) Appl. No.: 09/648,967

(22) Filed: Aug. 28, 2000

(51) Int. Cl.[7] ..... B21D 1/14
(52) U.S. Cl. ..... 72/454; 72/705; 29/897.1
(58) Field of Search ..... 72/295, 301, 302, 72/454, 705; 29/897.1

(56) References Cited

U.S. PATENT DOCUMENTS

| | | | | | |
|---|---|---|---|---|---|
| 858,965 | A | | 7/1907 | Dever | 403/45 |
| 1,714,187 | A | | 5/1929 | Pacy | 29/897.1 |
| 1,850,073 | A | * | 3/1932 | Countryman | 72/705 |
| 1,992,978 | A | | 3/1935 | Wilson et al. | 29/897.1 |
| 1,995,313 | A | | 3/1935 | Leake | 29/897.1 |
| 2,606,467 | A | * | 8/1952 | Desjarlais et al. | 72/705 |
| 2,708,380 | A | * | 5/1955 | Mais | 72/454 |
| 2,799,920 | A | * | 7/1957 | Hansen | 72/454 |
| 3,199,174 | A | | 8/1965 | Nilsson et al. | 29/402.19 |
| 3,271,008 | A | | 9/1966 | Kramer | 29/402.19 |
| 3,673,842 | A | | 7/1972 | Sanchez | 72/478 |
| 4,238,951 | A | * | 12/1980 | Grainger et al. | 72/457 |
| 4,916,793 | A | | 4/1990 | Kuhn | 29/402.19 |
| 4,937,989 | A | | 7/1990 | Miyares et al. | 29/402.19 |

* cited by examiner

*Primary Examiner*—David Jones
(74) *Attorney, Agent, or Firm*—James W. Hiney

(57) ABSTRACT

The invention relates to a device for straightening bridges that have had their lower girders bent by trucks passing underneath having loads higher than the clearance afforded by the bridge. The invention contemplates using a threaded rod with two clamping members to engage both the bent beam and a rigid part of the bridge to as to gradually bend the beam back into alignment by rotating a nut portion on the rod so as to turn the rod and allow one clamping member to move slowly along the rod. The clamping members have a portion designed to engage the flange area and thereby allow firm engagement of the beam by the straightening device.

12 Claims, 7 Drawing Sheets

103
128
129
125
126
127

BRIDGE STRAIGHTNER AND METHOD

This invention relates to a device for straightening bridges which have had their lower girders bent by trucks passing underneath with loads higher than the clearance afforded by the bridge.

THE PROBLEM

When trucks with illegal high loads pass under bridges, whether they be railroad, vehicular or pedestrian bridges, the load smashes into the lower bridge beams which results in the lower beams being bent. As the resulting impact bends the lower beams out of alignment and consequently weakens the bridge. This is a growing problem as there are more and more trucks on the road and the sizes of them is growing to such an extent that they barely fit on the road. Part of the growth has been vertical as well as length and in breadth. As the vehicles are limited by lane widths in their breadth and by state and federal laws in their length, already up to 57 feet on interstates, the trailer portions of them have gotten higher. While the normal enclosed trailer truck is built so that the top of the trailer just gets under the Federal standards for interstates those trucks with flatbeds carry all kinds of loads which are not necessarily in compliance with height standards. With the number of trucks growing enormously and the state police contingent of most states static the potential for bridge damage due to unchecked high loads has grown considerably. Truckers too avoid highway inspection stations and go down back roads if they know they have a load that is too high. In short, truckers have become a menace on the roads and the height problem is one manifestation of that situation.

THE SOLUTION

Heretofore, when bridge beams were bend, there was no simple way to correct it. In most cases the beams had to be actually removed and replaced. With the instant invention, a beam can be straightened in place thus eliminating a lost of costly work by highway departments and contractors.

The instant invention contemplates using a threaded rod with two clamping members to engage both the bent beam and a rigid part of the bridge to as to gradually bend the beam back into alignment by rotating a nut portion on the rod so as to turn the rod and allow one clamping member to move slowly along the rod. As most bridge beams have a flange on them, being either I-beams or similar beams, the clamping members have a portion designed to engage the flange area and thereby allow firm engagement of the beam by the straightening device.

The clamping member which engages the fixed structural portion of the bridge has a cross pin with a ball and socket arrangement therein, the ball and socket being machined into the cross pin thereby fixing the end of the rod in place. The opposite clamping member which engages the bent beam has a cross pin with an apeture drilled therein and tapped with threads so as to allow it to move along the threaded rod as it is turned. Thus, as the threaded rod is turned the mechanical advantage created by the cross pin will cause the beam to be manipulated back into its original position. The invention is used with several others to gradually move the beam back into place. If the beam is large enough, it will be heated as the pressure is gradually exerted by the turning of the nuts on the ends of the multiple straighteners.

The straighteners are designed to be adjustable both in the clamping members for any size beam and the length of the rods can be increased. Several different length rods are contained with a pair of clamping members. The diameter of the rods and holes in the clamping members will also vary depending on the size of the beams to be bent back into shape.

Having described the invention, the following objects of this invention are hereby enumerated.

It is an object of this invention to provide a bridge beam straightening device which can make the repair of bridges much easier and less expensive, It is a further object of this invention to provide a bridge beam straightening device which employs two clamping members and a tensioning device to close the distance between them to allow gradual straightening of a bridge beam.

It is a still further object of this invention to provide in a bridge beams straightening device a clamping device with a ball and socket arrangement so as to all a threaded rod to be turned and the clamping device remain in place.

Another object of this invention is to provide a novel and unique method of straightening bent bridge members and beams.

A still further object of this invention is to provide a novel group of straightening devices which can be used in tandem to straighten a bridge.

These and other objects of the invention will become apparent when reference is had to the accompany drawings in which FIG. 1 is a perspective view of the device of the instant invention showing the two clamping members and the threaded rod therebetween.

DESCRIPTION OF PREFERRED EMBODIMENT

Figure 1:
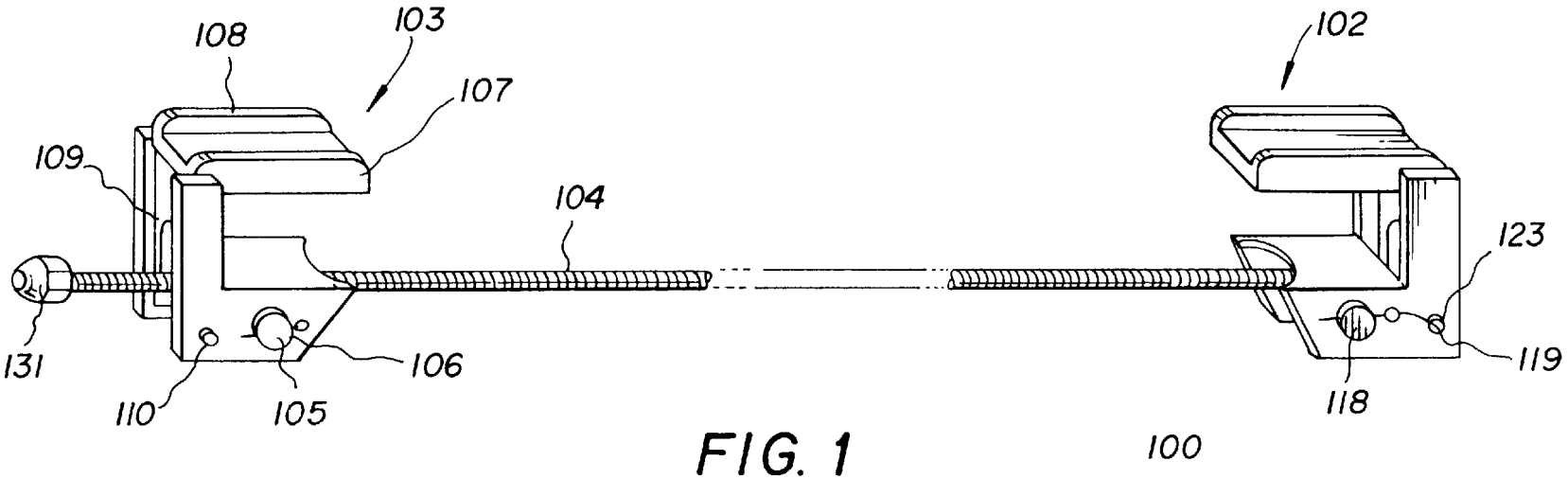
Figure 2:
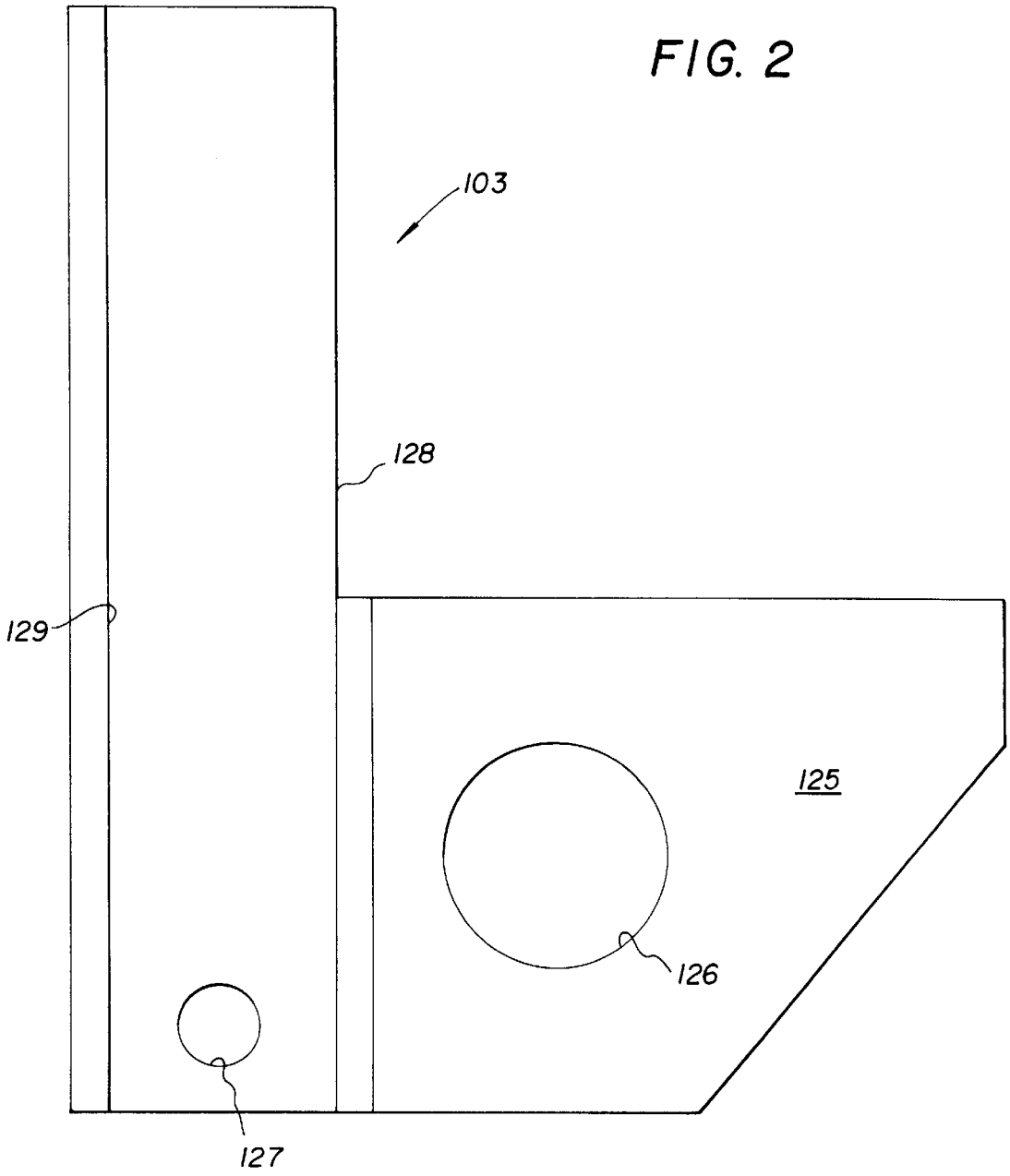
FIG. 2 is a side view of the main portion of the clamping members showing apeture for the cross pin and the apeture for the adjustment bolt.
Figures 3, 4:
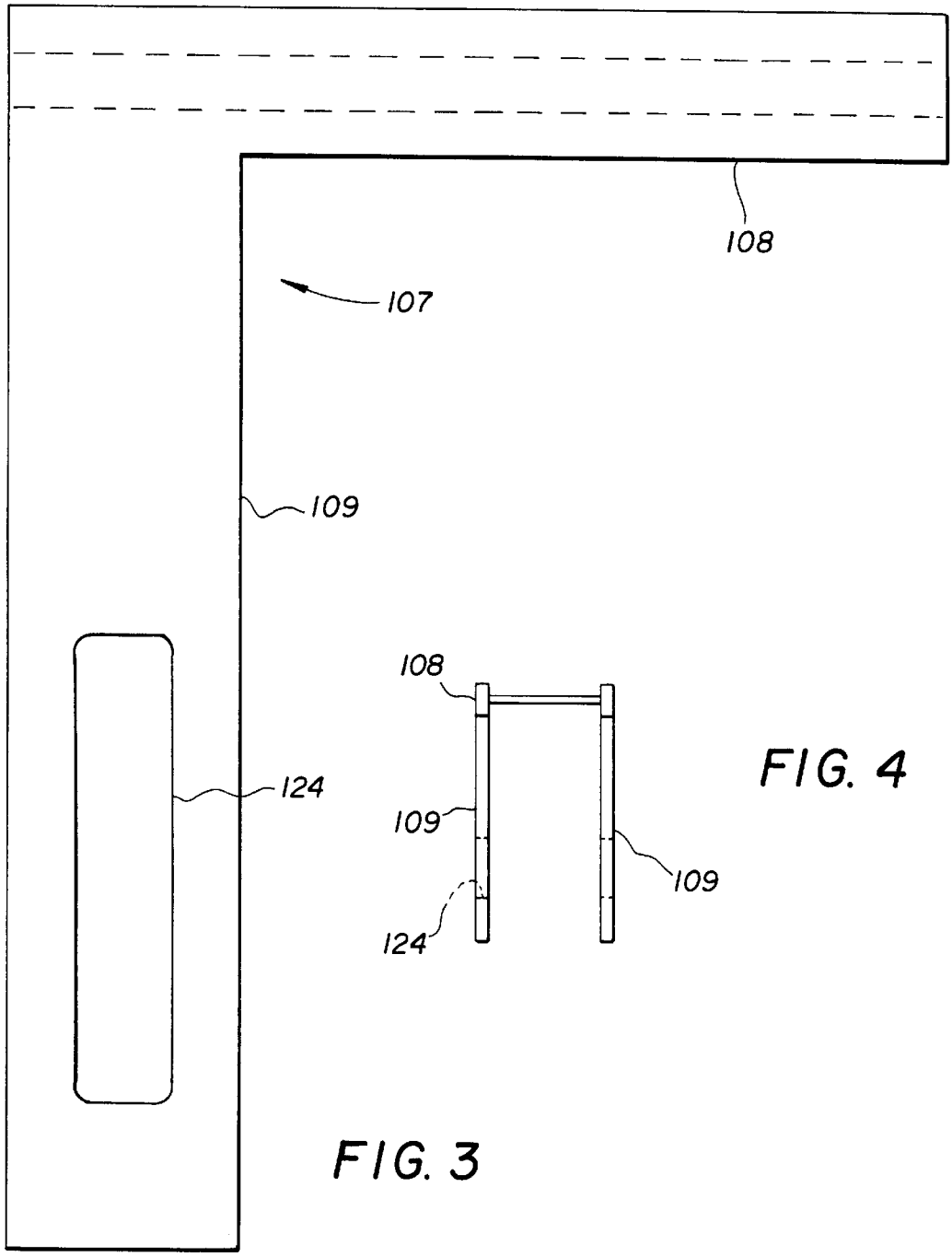
FIG. 3 shows the clamping member movable portion in side view.
FIG. 4 shows a front view of the clamping member movable portion in front view.
Figure 5:
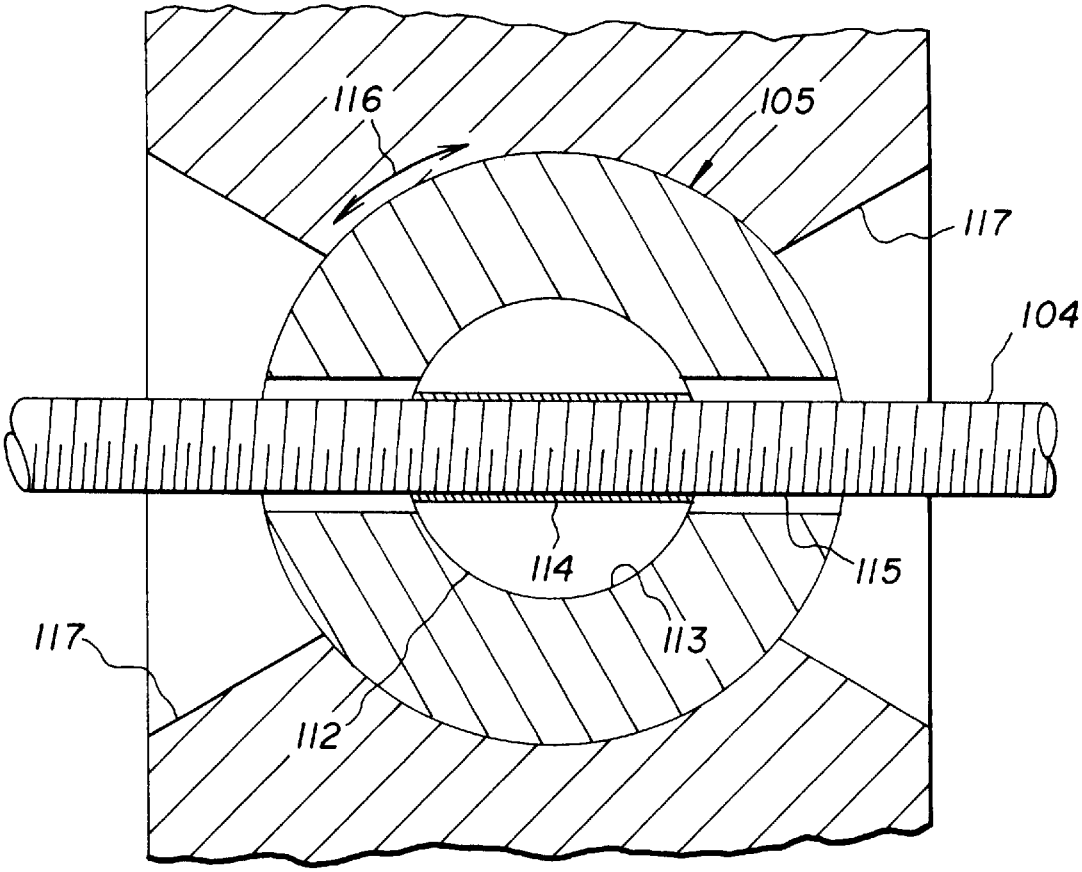
FIG. 5 shows the ball and socket arrangement on the fixed clamping member.

Referring now to FIG. 1 there is shown the overall straightening noted as 100. It consists of two clamping members, 102 and 103, each on one end of a threaded rod 104. The fixed clamping member, 102, has a cross pin 105 therein which is held in place by a cotter pin 106 therein. An adjustable portion 107 has a engaging part 108 and a depending portion 109. Portion 109 has an elongated slot 124 therein which is engaged by fastening bolts such as 110 to hold adjustable portion 107 in place on member 103. A As seen in FIG. 5 the cross pin 105 of member 103 has a ball and socket arrangement 111 therein consisting of ball portion 112 and the socket 113. Ball 112 is attached to rod 104 as at 114 so as to allow turning movement of rod 104 within cross pin 105 therein while advancing rod 104. The cross pin 105 has non threaded apertures therein to allow for insertion and free turning of rod 104 relative to the fixed clamping member 103.

Figure 6:
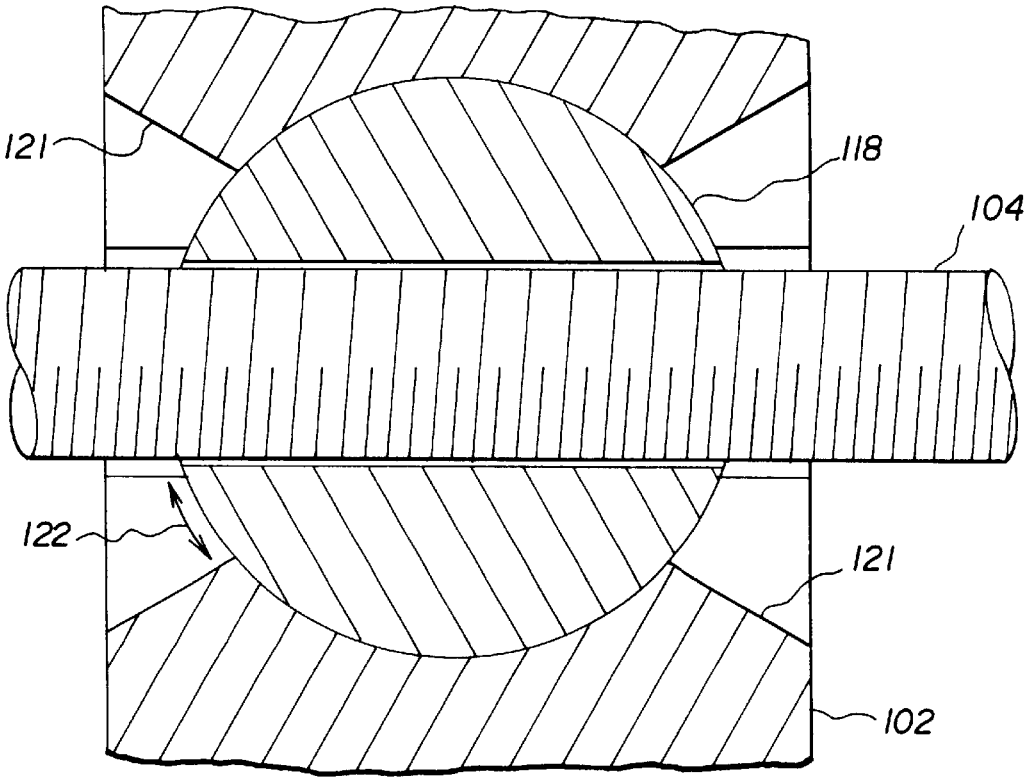
FIG. 6 shows the arrangement between movable clamping member and the threaded rod.

Due to ball 112 being attached to rod 104 and the cross pins free to rotate within the beam clamping devices, the whole arrangement is free to allow alignment of the threaded rod by pivoting such as at 116 and will prevent damage to the threads. An area 117 of the clamping member is cut away so as to allow alignment movement of the cross pin while moving clamping member 102. The arrangement of clamping member 102 is shown in FIG. 6 and shows a cross pin 118 held in place by cotter pin 119. Cross pin 118 is drilled and tapped with threads as at 120 so as to accommodate the threaded rod 104. As the rod is turned the clamping member 102 in which cross pin is located will move along the rod by the threads of the rod 104 engaging the threads of the drilled and tapped cross pin 118. Member 102 is cut away as at 121 so as to allow alignment between the two clamping members 102 and 103 which facilitates rotation of cross pin 118 as at 122.

Member 103 has a central portion 125 which the cross pin 106 is adapted to be held in aperture 126. Aperture 127 is adapted to receive a bolt 110 which protrudes through slot 124 in depending portion 109 and holds the two portions of member 103 in a clamping position for a particular sized beam flange. Portion 128 extends upwardly from the base and has a flange 129 adapted to receive the edge of portion 109 to center the two portions of member 103 and hold it together with bolts such as 110.

The two upper portions are held together by a central portion 130 which comprises to top portion of member 103.

Member 102 is constructed the same as member 103 except for the threaded bolt connection as shown in FIG. 6. On rod 104 is a fixed nut 131 which is adapted to be engaged by a pneumatic tool or a mechanical bar wrench to turn rod 104 to affect straightening of the bent beam or girder.

Figure 7:
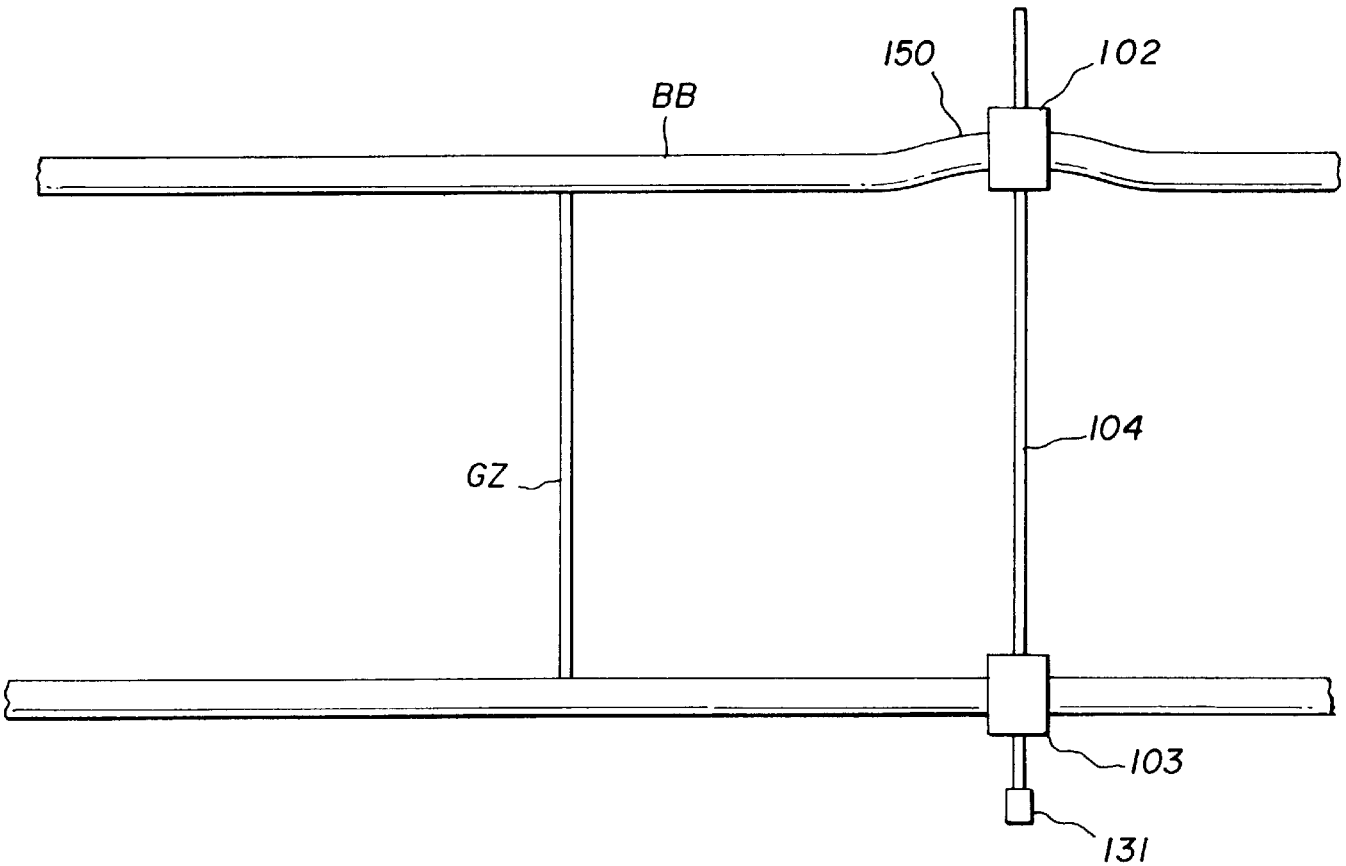
FIG. 7 shows a bent bridge beam with one of the devices being employed to straighten it.

FIG. 7 shows a diagrammatic view of the invention in use on a bridge beam. The bridge beams BB are parallel in this view which shows the bottom of the bridge structure. BB has been knocked out of alignment. Movable member 102 is secured to the bent portion 150 of BB. By turning on nut 131 the rod will gradually turn and pull section 150 back into alignment. This process eliminates replacing the entire beam BB which is an expensive process.

Figure 8:
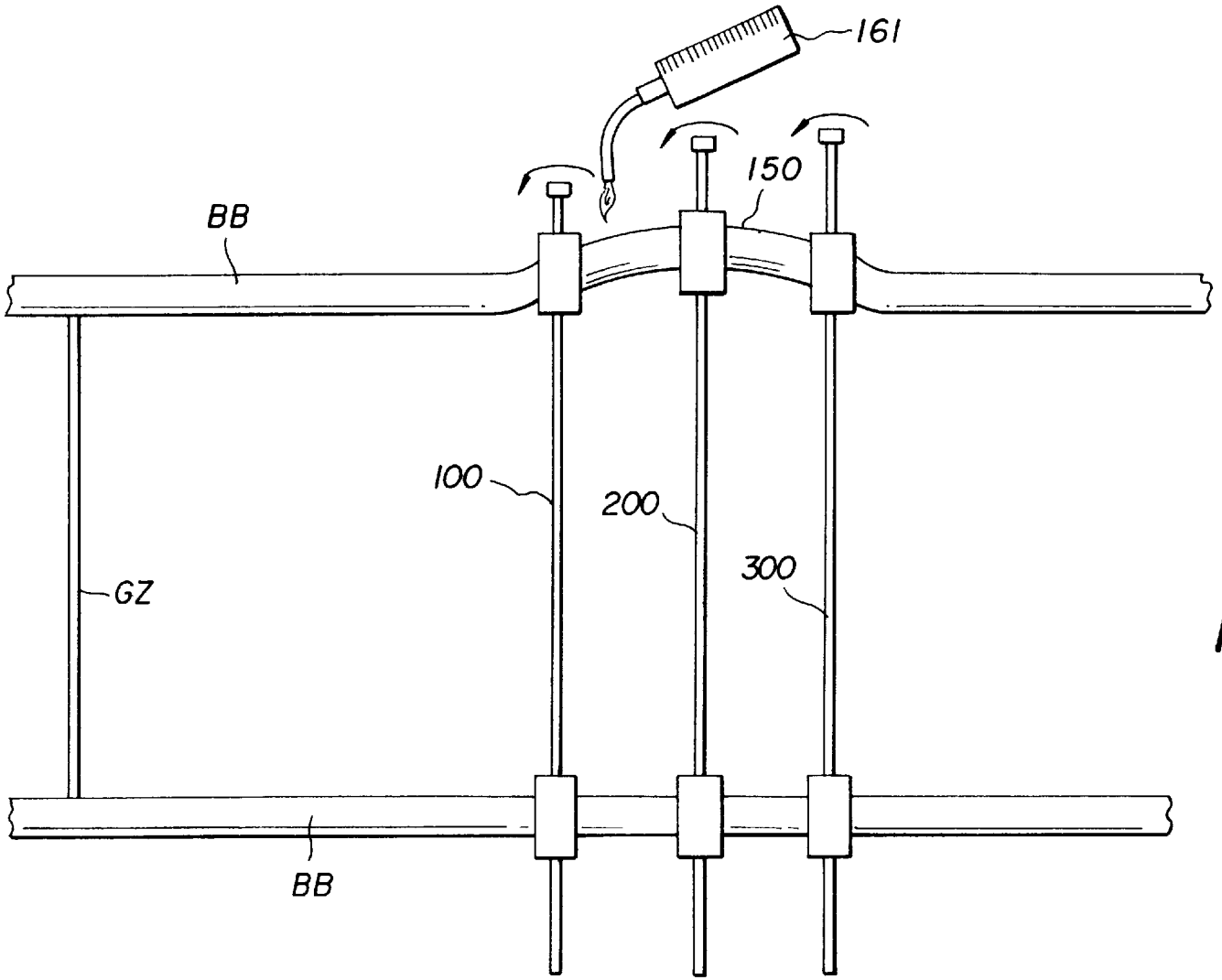
FIG. 8 shows multiple employment of the invention together with the use of heating to facilitate bending.

FIG. 8 shows the use of several of the straighteners, 100, 200 and 300 in use on the bridge of FIG. 7. As the straighteners 100 are tightened gradually to pull the beam back into place, heat is applied by an acetylene torch 161 along the bent portion 160 to faciliate bending of bridge beam. This process involves gradually tightening the nuts on each straightener, heating the bent girder portion and continuing to tighten each nut to allow the straighteners to act upon the more fluid steel when it is in a heated, more ductile condition.

Having described the preferred embodiment of this invention, it will be obvious to those of ordinary skill in the art to make changes and modifications thereto without departing from the scope of the appended claims.

What is claimed is:

1. A method of straightening bent bridge beams and girders with a tensioning device with two ends, said method comprising attaching one end of at least one tensioning device having a threaded rod to the bent beam or girder, attaching the other end of said tensioning device to a rigid portion of said bridge, applying tension to said tensioning device while allowing the tensioning device to self-align itself while tension is being applied to it, continuing to apply tension to said tensioning device until said beam or girder is aligned, and detaching said tensioning device from said bridge.

2. The method of claim 1 and including the step of applying heat to the bent portion of said beam or girder while applying tension to said tensioning device.

3. The method of claim 1 in which at least two tensioning devices are used.

4. The method of claim 3 including the step of applying heat to the bent portion of said beam or girder while applying tension to said two tensioning devices.

5. A bridge beam or girder straightening device, said device comprising a threaded rod with a turning nut on one end, a first clamping member receiving one portion of said rod so as to allow the rod to turn free relative to said first clamping member, a second clamping member receiving the end of said threaded rod opposite said turning nut in a manner that allows said member to move along said rod when said rod is turned by said nut being engaged by a force applying means, at least one clamping member having a means to allow universal movement of said rods within the respective clamping members, whereby as tension is applied by turning said rod the movable clamping member moves toward said other clamping member to affect proper alignment of any bent beam or girder in the bridge.

6. A straightening device as in claim 5 wherein said means to allow universal movement of said rod comprises, within said first clamping member, a ball and socket means engaging said threaded rod, whereby said rod is engaged onto said ball and said ball is free to rotate within said member to allow the position of said rod and member to remain constant.

7. The device of claim 6 and including a cross pin means, the ball and socket located within said cross pin means and said cross pin means being free to rotate within said member so as to afford a self-aligning feature to said clamping member.

8. The device of claim 5 wherein said first clamping member is comprised of two portions, the portions being movable with relation to one another so as to afford adjustability to said clamping member.

9. The device of claim 8 wherein said second clamping member is comprised of two portions like said first clamping member and is likewise adjustable.

10. A device as in claim 5 and including cross pins rotatably mounted in said two clamping members, the threaded rod engaging said cross pins so as to allow for self aligning adjustment of said rod when the device is in use.

11. A device as in claim 10 and including a ball and socket means in said first clamping member and said threaded rod engaging said ball so as to allow for rotation of said rod without changing its position relative to said first clamping member.

12. A device as in claim 11 and including a bolt means on both said clamping means for providing, in conjunction with an adjustable clamping portion on each clamping member, means to hold any adjusted position on said members.

* * * * *